US008766073B2

(12) United States Patent
Eckermann

(10) Patent No.: US 8,766,073 B2
(45) Date of Patent: Jul. 1, 2014

(54) RESONANCE MECHANISM FOR DRUMS (MEMBRANOPHONES)

(75) Inventor: Norbert Eckermann, Vienna (AT)

(73) Assignee: Roland Meinl Musikinstrumente GmbH & Co. KG, Gutenstetten (DE)

( * ) Notice: Subject to any disclaimer, the term of this patent is extended or adjusted under 35 U.S.C. 154(b) by 0 days.

(21) Appl. No.: 13/527,079

(22) Filed: Jun. 19, 2012

(65) Prior Publication Data

US 2012/0325072 A1 Dec. 27, 2012

(30) Foreign Application Priority Data

Jun. 24, 2011 (AT) ..... 927/2011

(51) Int. Cl.
*G10D 13/02* (2006.01)

(52) U.S. Cl.
USPC ..... 84/411 R

(58) Field of Classification Search
USPC ..... 84/411 R
See application file for complete search history.

(56) References Cited

U.S. PATENT DOCUMENTS 494,485 A * 3/1893 Nightingale ..... 84/294
4,060,018 A * 11/1977 Gilbrech ..... 84/269
4,214,504 A * 7/1980 Rex ..... 84/411 R
4,356,757 A * 11/1982 Mooy ..... 84/411 R
5,492,047 A * 2/1996 Oliveri ..... 84/411 M
6,069,307 A * 5/2000 Rogers ..... 84/411 R
7,214,867 B1 * 5/2007 Gatzen et al. ..... 84/411 R
7,439,431 B2 * 10/2008 Jakonczuk ..... 84/413
7,476,794 B2 * 1/2009 May, Jr. ..... 84/411 R
7,560,632 B1 * 7/2009 Lanzel et al. ..... 84/411 R
7,781,661 B2 * 8/2010 Rogers et al. ..... 84/413
7,785,169 B2 * 8/2010 Moss ..... 446/418
8,093,477 B1 * 1/2012 Twyford ..... 84/411 R
8,148,619 B1 * 4/2012 May et al. ..... 84/411 M
8,294,013 B2 * 10/2012 Lento ..... 84/411 R
2003/0070533 A1 * 4/2003 Ezbicki ..... 84/411 R
2010/0083812 A1 * 4/2010 Peavey ..... 84/411 R
2010/0175535 A1 * 7/2010 Lento ..... 84/414
2011/0138988 A1 * 6/2011 Lento ..... 84/414
2012/0325072 A1 * 12/2012 Eckermann ..... 84/411 R

* cited by examiner

*Primary Examiner* — Robert W Horn
(74) *Attorney, Agent, or Firm* — Browdy and Neimark, PLLC

(57) ABSTRACT

The presence of the described resonance device in the form of resonators (3, 4) influences the vibration characteristics of a membrane (2) in a defining manner and ensures a harmonic relationship between the fundamental and overtones of the drum sound, even if said drum does not have a closed sound box or shell (1).

In orchestras and ensembles, but also as a solo instrument, the acoustic presence is improved by the increased energy conversion efficiency of the instrument and by the increased precision of the overtone characteristics with the aid of the ring resonators (3,4). The resonance device therefore enables the drum to be precisely tuned to a fundamental pitch in a given harmonic musical concept.

5 Claims, 1 Drawing Sheet

RESONANCE MECHANISM FOR DRUMS (MEMBRANOPHONES)

The present invention relates to a resonance mechanism for drums and a drum in which such a resonance mechanism is used.

This resonance mechanism effects a balanced sound spectrum in a drum.

The object of the present invention is based on the problem that musicians experience who must tune different drums in an ensemble, orchestra, choir, or as a soloist to a given fundamental pitch (comparable to a timpani, kettle drum in an orchestra, or the Indian tabla in an ensemble or played by soloists). Membranophones having a membrane on one or both sides of the drum kettle or frame do not provide a composer, musician, conductor or ensemble with a precise harmonic sound quality.

The different bearing edges of various angular degrees in percussion-instrument and drum shells combined with a membrane have overtone characteristics that do not sound harmonious.

BACKGROUND ART

The background art enables a harmonic balance of the sound spectrum of the fundamental and overtones of a drum to be achieved only when a closed shell or sound box is present (timpani, orchestral kettledrum, Indian tabla).

The invention is therefore based—as noted above—on the object of achieving a balanced sound spectrum in a drum.

This object is achieved by the resonance device specified in claim 1, which is characterized in that ring resonators in closed and/or open design are present on a drum kettle or shell that is covered by at least one membrane, beneath the membrane.

The dependent claims set out preferred embodiments of the invention, according to which the drum kettle or the shell is provided at each end with a membrane, a ring resonator being provided beneath the membrane.

According to a further preferred embodiment, the resonance device has ring resonators in the form of a continuous groove beneath a membrane on a drum kettle or shell.

In such a resonance device in closed design the cavity of the ring resonator may be spanned by a membrane.

The invention will now be explained in more detail with reference to the appended drawings.

Figure 1:
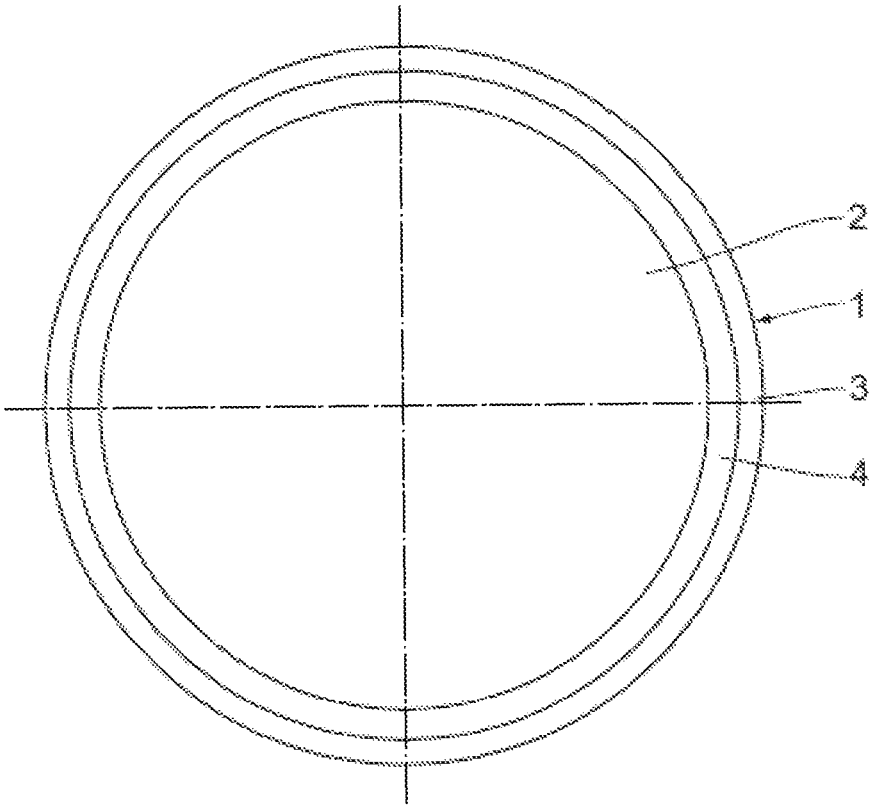
FIG. 1 shows a top view of a drum shell that is open on one side, and the positioning of the resonators on the upper edge thereof.
Figure 2:
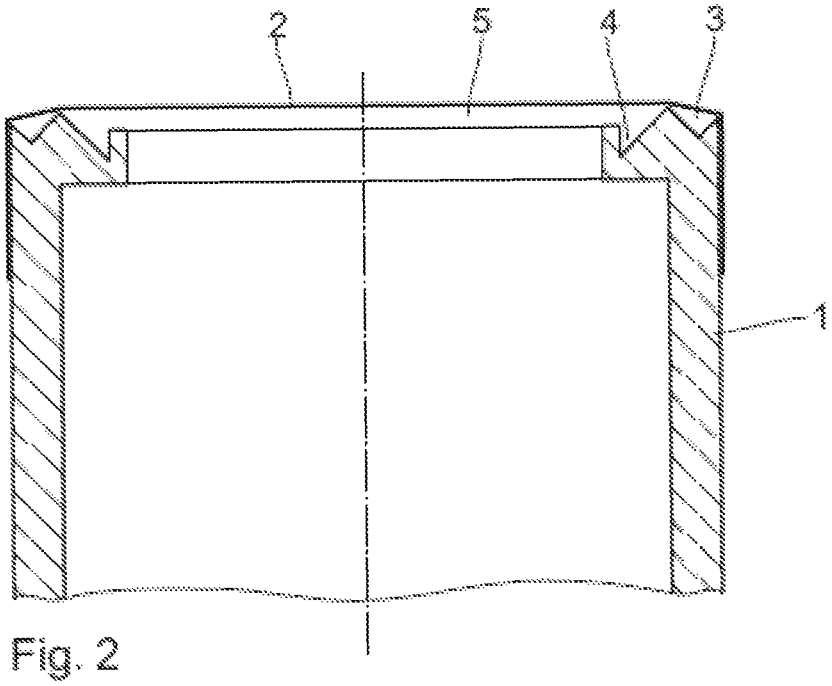
FIG. 2 shows a detail view with the resonators.

Owing to the resonance device shown, harmonic vibration characteristics of a membrane (2) are ensured even in a sound box or drum shell (1) that is open on one side. The ring resonator in closed design (3) defines the overtone characteristics of the drum shell in a way so that only desired, harmonic frequencies are created. The ring resonator in open design (4) defines the overtone characteristics of the membrane in a way so that only desired, harmonic frequencies are created. In this way the energy conversion efficiency of the drum is increased and the drumming technique used to achieve certain predominant, desired, dominant tones of the drum sound is facilitated. The sound volume at the same stroke intensity is higher and makes it easier for the musician to fit in with the dynamics of an orchestra or ensemble.

The resonance device comprises one to two or more ring resonators (3,4) which are positioned on the edge of a kettle or shell (1) of a drum, beneath the membrane (2). The ring resonators (3, 4) may be open (4) via a gap (5) or closed (3). The ring resonators (3,4) may each be used individually or in combination.

Both ring resonators (3,4) may be shaped to have a triangular or a round profile. The closed ring resonator (3) has a precisely dimensioned volume that is covered by the membrane (2) and effects desired, harmonic resonance overtone characteristics of the drum shell (1).

The ring resonator (4) that is open via a gap (5) likewise has a precisely dimensioned volume and effects desired, harmonic resonance overtone characteristics of the membrane (2) that spans the ring resonator (4).

What is claimed is:

1. A resonance device positioned on a drum kettle or shell that is covered by at least one membrane, the resonance device comprising a first ring resonator having a cavity, the first ring resonator being positioned on the drum kettle or shell and having a closed design wherein the cavity of the ring resonator is spanned by the membrane.

2. The resonance device according to claim 1, wherein the drum kettle or shell is covered at each end with a membrane, and the first ring resonator is disposed beneath the membrane.

3. The resonance device according to claim 1, wherein the first ring resonator is provided in the form of a continuous groove beneath a membrane on the drum kettle or shell.

4. The resonance device according to claim 1, further comprising a second ring resonator positioned radially outwardly of the first ring resonator and having a cavity that is open beneath the membrane via a gap.

5. A drum, in particular a drum having a sound box that is open on one side, comprising one or two resonance devices according to claim 1.

* * * * *